US007773890B2

(12) United States Patent
Chiba et al.

(10) Patent No.: US 7,773,890 B2
(45) Date of Patent: Aug. 10, 2010

(54) TONER SUPPLIER, TONER SUPPLY METHOD, IMAGE FORMING APPARATUS AND TONER SUPPLY SYSTEM

(75) Inventors: Keizoh Chiba, Numazu (JP); Hiroshi Tateishi, Fujinomiya (JP); Hirosato Amano, Numazu (JP); Tetsuo Noji, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 713 days.

(21) Appl. No.: 11/685,059

(22) Filed: Mar. 12, 2007

(65) Prior Publication Data

US 2007/0223945 A1 Sep. 27, 2007

(30) Foreign Application Priority Data

Mar. 23, 2006 (JP) ..... 2006-081522

(51) Int. Cl.
*G03G 15/08* (2006.01)

(52) U.S. Cl. ..... 399/27; 399/258

(58) Field of Classification Search ..... 399/8, 399/27, 258

See application file for complete search history.

(56) References Cited

U.S. PATENT DOCUMENTS

| | | | | |
|---|---|---|---|---|
| 5,915,154 | A * | 6/1999 | Schoch et al. | 399/258 |
| 6,679,301 | B2 | 1/2004 | Makino et al. | |
| 6,859,634 | B2 | 2/2005 | Itoh et al. | |
| 7,155,149 | B2 * | 12/2006 | Fujii et al. | 399/258 |
| 7,463,853 | B2 * | 12/2008 | Sano et al. | 399/258 |
| 7,587,152 | B2 * | 9/2009 | Itoh et al. | 399/88 |
| 2005/0244193 | A1 | 11/2005 | Amano et al. | |

FOREIGN PATENT DOCUMENTS

| | | |
|---|---|---|
| JP | 7-325514 | 12/1995 |
| JP | 10-49025 | 2/1998 |
| JP | 2000-199994 | 7/2000 |
| JP | 2001-228762 | 8/2001 |
| JP | 2002-132922 | 5/2002 |
| JP | 2002-296886 | 10/2002 |
| JP | 2002-373270 | 12/2002 |
| JP | 2003-104301 | 4/2003 |
| JP | 2003-192128 | 7/2003 |
| JP | 2003-331112 | 11/2003 |
| JP | 2004-83130 | 3/2004 |
| JP | 3534159 | 3/2004 |
| JP | 2005-75375 | 3/2005 |
| JP | 2005-92100 | 4/2005 |
| JP | 2005-114798 | 4/2005 |
| JP | 2005-215655 | 8/2005 |

* cited by examiner

*Primary Examiner*—William J Royer
(74) *Attorney, Agent, or Firm*—Oblon, Spivak, McClelland, Maier & Neustadt, L.L.P.

(57) ABSTRACT

A toner supplier, including a toner container configured to contain a toner, an air discharger configured to discharge air from a bottom of the toner container to form a fluidized toner, a detector configured to detect usage information of the toner contained in the toner container, and a communicator configured to send and receive the usage information. The communicator is configured to communicate with an image forming apparatus connected to the toner supplier and a controller connected to the toner supplier.

14 Claims, 10 Drawing Sheets

TONER SUPPLIER, TONER SUPPLY METHOD, IMAGE FORMING APPARATUS AND TONER SUPPLY SYSTEM

CROSS REFERENCE TO RELATED APPLICATIONS

This application claims priority and contains subject matter related to Japanese Patent Application No. 2006-081522 filed on Mar. 23, 2006, the entire contents of which are hereby incorporated by reference.

BACKGROUND OF THE INVENTION

1. Field of the Invention

The present invention relates to a toner supplier, and to an image forming apparatus and a toner supply system the toner supplier is connected to.

2. Discussion of the Background

When a toner container set in a conventional image forming apparatus becomes empty, the toner container is replaced with a new container filled with a toner. When a user consuming a large amount of toner, such as a commercial printer, has to frequently exchange the toner container there is a need to reduce the number of exchanges. Further, a toner producer needs to know a user's toner usage status correctly so as to produce the toner just in proportion and provide the toner to a user just in time.

Japanese Patent No. 3534159 discloses a toner bank including a well-operable and simply-detachable toner container capable of safely preventing a toner from scattering, and an image forming apparatus having the toner bank.

Published Unexamined Japanese Patent Application No. 2005-215655 discloses a waste toner collector transporting a residual toner removed by a cleaner from an image bearer and a transferer, and an image forming apparatus equipped therewith.

However, Japanese Patent No. 3534159 cannot reduce the number of exchange because the toner container has a capacity similar to that of the conventional container. Published Unexamined Japanese Patent Application No. 2005-215655 cannot increase a capacity of the toner collector because of being installed in the image forming apparatus.

Because of these reasons, a need exists for a toner supplier, an image forming apparatus and a toner supply system, which are capable of reducing the number of exchanges of a toner container, and through which a toner producer can know a user's toner usage status correctly.

SUMMARY OF THE INVENTION

Accordingly, an object of the present invention is to provide a toner supplier capable of reducing the number of exchanges of a toner container.

Another object of the present invention is to provide a toner supply method using the toner supplier.

A further object of the present invention is to provide an image forming apparatus using the toner supplier.

Another object of the present invention is to provide a toner supply system using the toner supplier, and through which a toner producer can know a user's toner usage status correctly.

These objects and other objects of the present invention, either individually or collectively, have been satisfied by the discovery of a toner supplier, including a toner container configured to contain a toner, an air discharger configured to discharge air from a bottom of the toner container to form a fluidized toner, a detector configured to detect usage information of the toner contained in the toner container, and a communicator configured to send and receive the usage information. The communicator is configured to communicate with an image forming apparatus connected to the toner supplier and a controller connected to the toner supplier.

These and other objects, features, and advantages of the present invention will become apparent upon consideration of the following description of the preferred embodiments of the present invention taken in conjunction with the accompanying drawings.

BRIEF DESCRIPTION OF THE DRAWINGS

Various other objects, features, and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
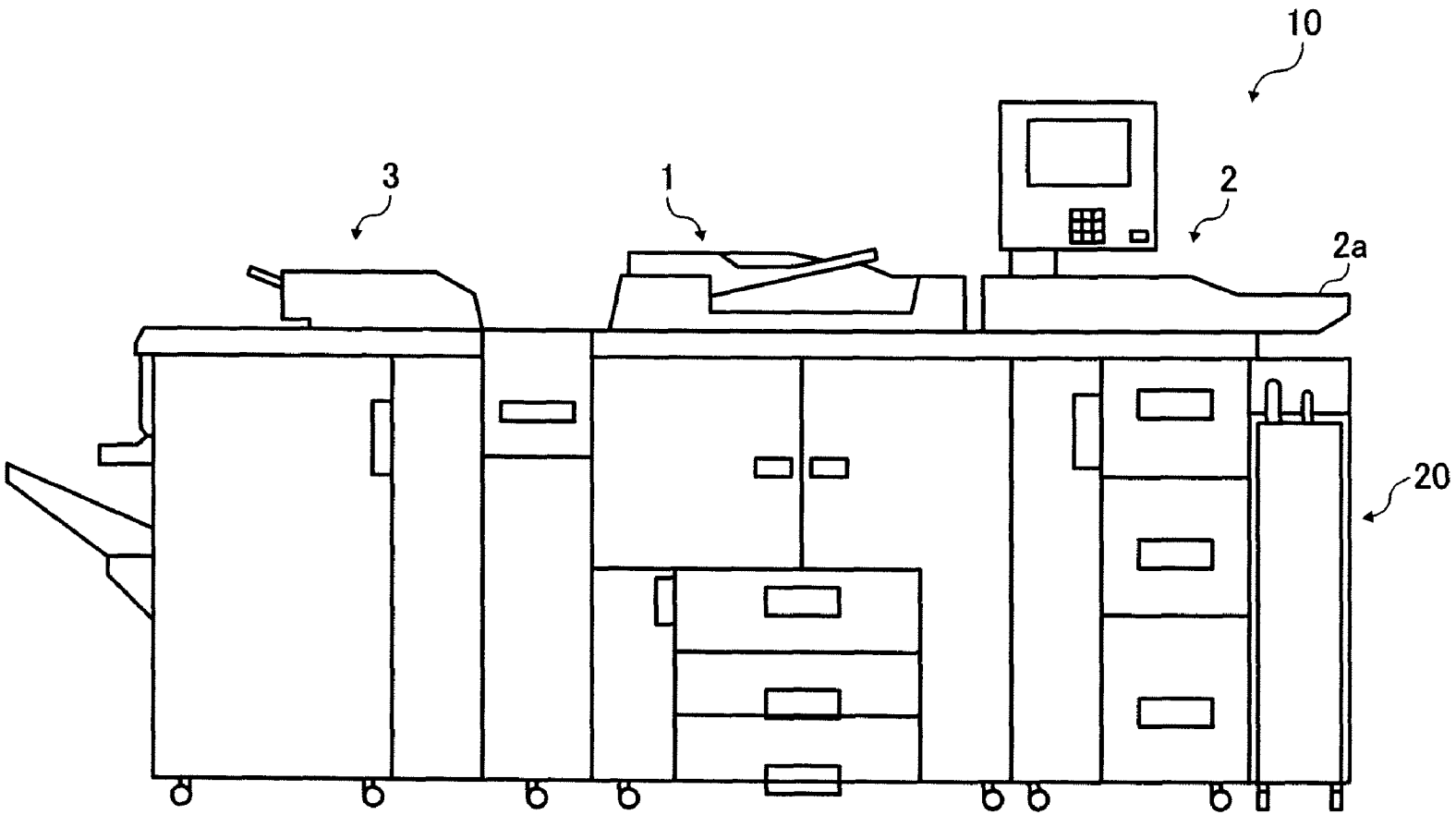
FIG. 1 is an external schematic view illustrating an embodiment of the image forming apparatus of the present invention.

The present invention provides a toner supplier, and a toner supply method, an image forming apparatus and a toner supply system using the toner supplier, which are capable of transporting a large amount of a toner, and through which a toner producer can know a user's toner usage status correctly.

The present invention transports a toner by aspirating the toner fluidized in a toner container of a toner supplier. Further, the present invention transmits usage information of the toner and status of the toner supplier to a controller controlling the toner supplier to be displayed such that a producer of the toner can review to produce the toner just in proportion.

An embodiment of the present invention will be explained, referring to the drawings.

FIG. 1 is an external schematic view illustrating an embodiment of the image forming apparatus of the present invention. An image forming apparatus 10 is formed of a duplicator 1, a paper feeder 2, a postprocessor 3 and a toner supplier 20.

The image forming apparatus 10 forms an image at the duplicator 1 and fixes the image on a recording paper stored in the paper feeder 2. The postprocessor 3 sorts and staples the recording papers as a user desires.

The duplicator 1 electrostatically transfers a powder toner to a photoreceptor drum and to the recording paper. The paper feeder 2 includes a paper feed tray having a wing 2*a*.

The toner supplier 20 is located below the wing 2*a*. The location of the toner supplier 20 is not limited thereto and can be located as a user desires. In this embodiment, a dead space due to the projecting wing 2*a* is effectively used for locating the toner supplier 20.

Figure 2:
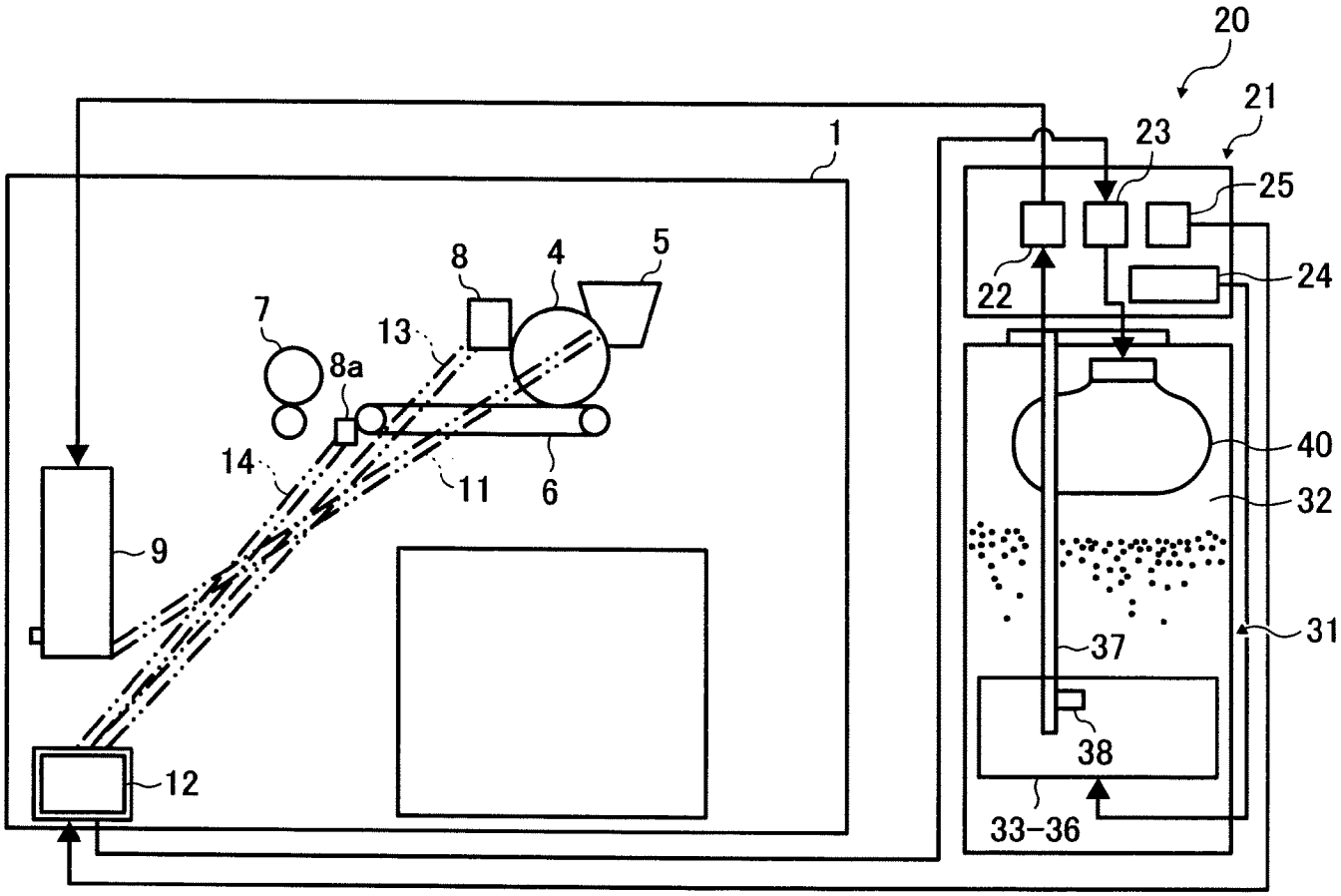
FIG. 2 is a schematic view for explaining a relation of connection between the image forming apparatus and a toner supplier of the present invention.

Next, a method of supplying a toner from the toner supplier 20 will be explained, referring to FIGS. 2 and 3. FIG. 2 is a schematic view for explaining a relation of a connection between the duplicator 1 and the toner supplier 20, and FIG. 3 is an external perspective view illustrating the toner supplier 20.

In FIG. 2, the duplicator 1 includes a photoreceptor drum 4 as an image bearer. When the photoreceptor drum 4 rotates clockwise, the surface thereof is uniformly charged by a charger (not shown) . The charged surface is irradiated with light such as a laser beam to form an electrostatic latent image thereon. The electrostatic latent image is visualized with a powder toner to form a toner image at an image developer 5, and the toner image is transferred by a transfer belt 6 onto a recording paper fed from the paper feeder 2 at a predetermined interval.

The recording paper the toner image is transferred on is transported to a fixer 7, at which the toner image is fixed thereon as an eternal image. On the other hand, a residual toner remaining on the surface of the photoreceptor drum 4 after being transferred is removed therefrom by a cleaner 8. The image forming apparatus 10 repeats these processes to continuously produce images. A toner remaining on the transfer belt 6 is removed by a belt cleaner 8*a* and is accumulated in a waste toner collector 12 as a waste toner.

Figure 3:
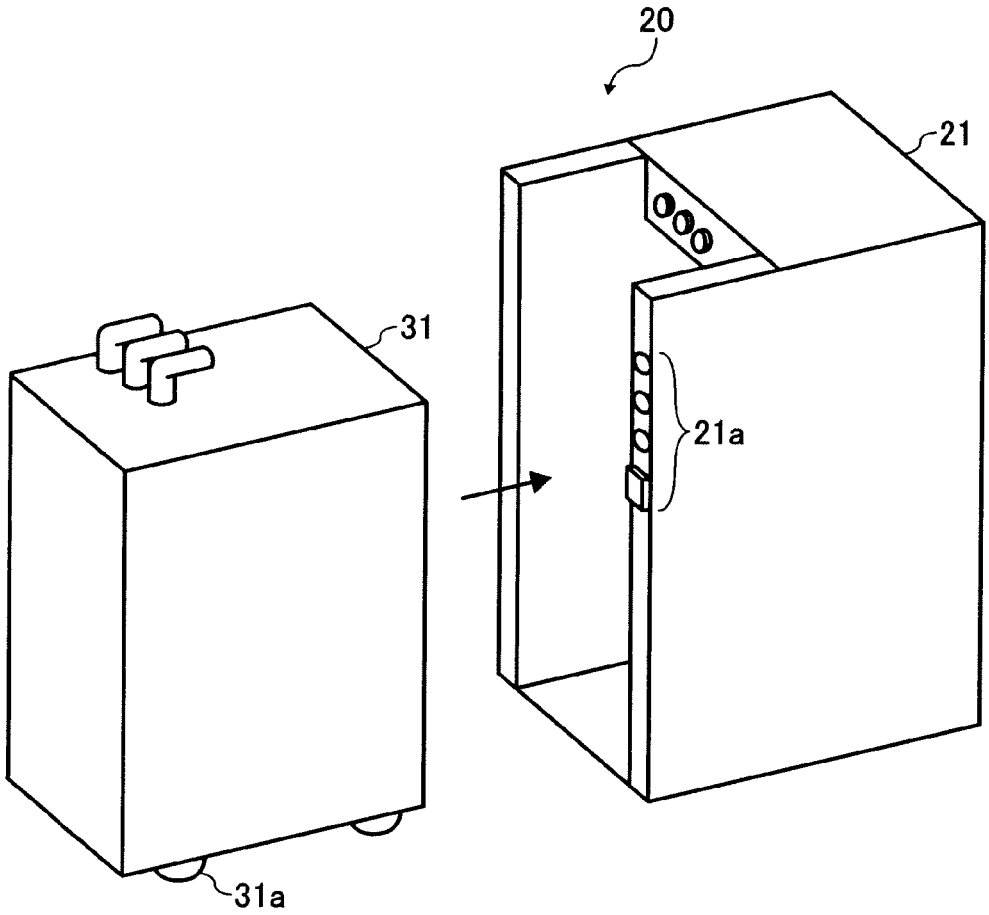
FIG. 3 is an external perspective view illustrating the toner supplier of the present invention.

As FIGS. 2 and 3 show, the toner supplier 20 is formed of a fixed part 21 fixed on the paper feeder 2 and a toner tank unit 31 containing the toner.

Figure 6:
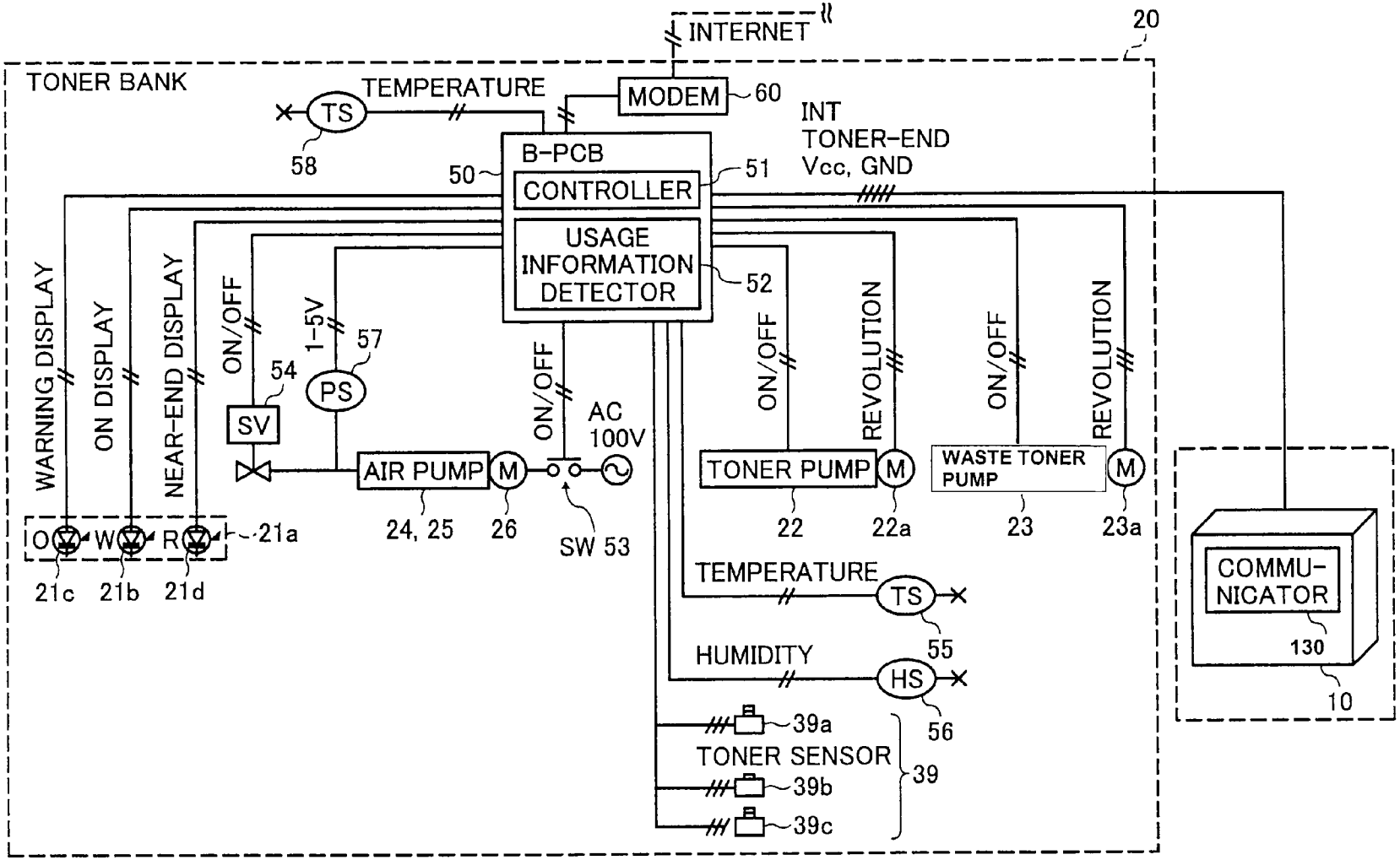
FIG. 6 is a schematic diagram of an embodiment of the toner supplier of the present invention.

The fixed part 21 includes a display 21*a*, a toner pump 22, a waste toner pump 23, air pumps 24 and 25, a control board 50 (FIG. 6) and a modem 60 (FIG. 6). The display 21*a* is formed of, e.g., plural LEDs and displays the status of the toner supplier 20 by changing the color of the LEDs or blinking the LEDs.

The toner pump 22 transports the toner contained in the toner tank unit 31 to the image forming apparatus 10. The waste toner pump 23 transports the waste toner accumulated in the waste toner collector 12 to the toner tank unit 31.

The air pump 24 supplies air to fluidize the toner contained in the toner tank unit 31. The air pump 25 supplies air to fluidize the waste toner accumulated in the waste toner collector 12 when transported.

The control board 50 includes a controller 51 for controlling the operation of the toner supplier 20 and a usage information detector 52 detecting the usage information of the toner in the toner tank unit 31. The modem 60 is a communicator communicating with a center server controlling the toner supplier 20, which is connected thereto through a network. Details of the control board 50 and modem 60 will be explained later.

The toner tank unit 31 includes a castor 31*a*, a toner tank 32 and a waste toner collection container 40. The castor 31*a* makes it easy to transport the toner tank unit 31 when removed from the fixed part 21. The toner tank 32 contains a toner and the toner contained therein is supplied to the duplicator 1 of the image forming apparatus 10. The waste toner collection container 40 is located above the toner tank 32 and the waste toner transported from the waste toner collector 12 is accumulated therein.

The toner supplied to the duplicator 1 from the toner supplier 20 is transported from the toner tank 32 by the toner pump 22 to a toner hopper 9 in the duplicator 1. The toner transported to the toner hopper 9 is further transported by a toner transporter such as a transport coil and a powder pump to a developing hopper (not shown) of the image developer 5 through a transport route 11.

The toner supplier 20 will be explained in detail, referring to FIGS. 4 and 5.

Figure 4:
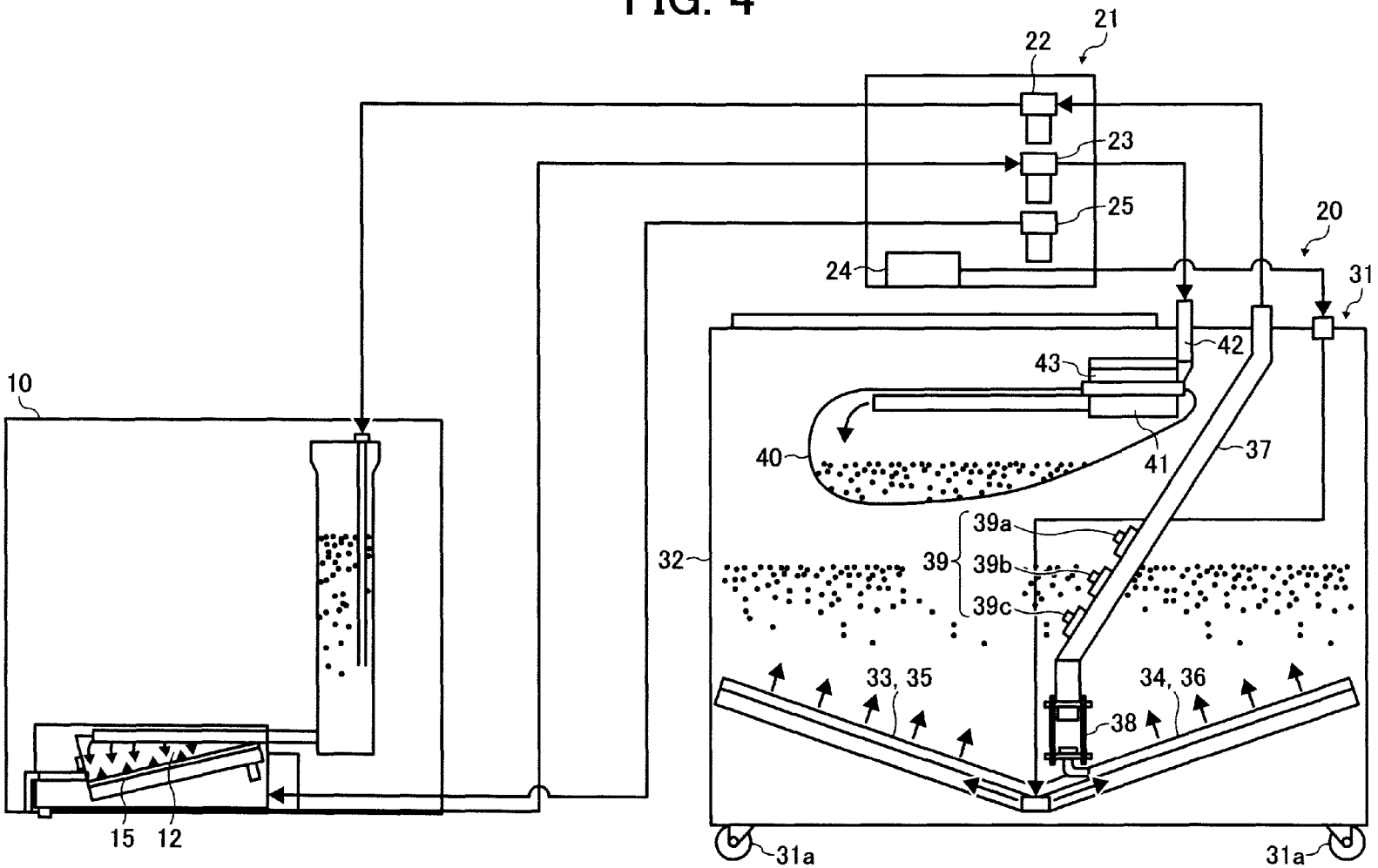
FIG. 4 is a schematic view for explaining an internal constitution of the toner supplier of the present invention.
Figure 5:
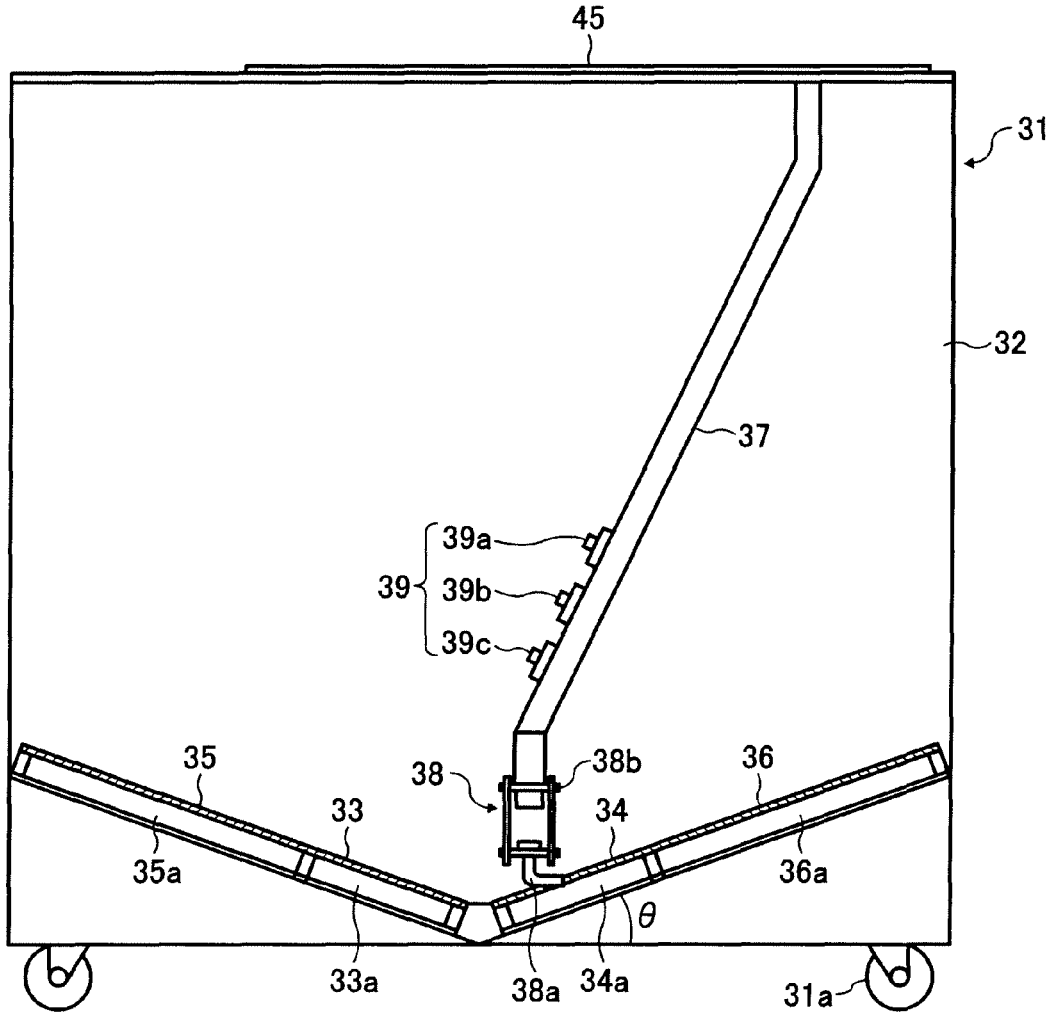
FIG. 5 is a schematic view for explaining a toner tank of the toner supplier of the present invention.

FIG. 4 is a schematic view for explaining an internal constitution of the toner supplier 20. FIG. 5 is a schematic view for explaining the toner tank 32.

As FIG. 4 shows, the toner tank 32 of the toner tank unit 31 has a V-style gradient at the bottom. In the present invention, the angle thereof is about 20° and is preferably smaller than a repose angle of the toner contained in the toner tank 32. The smaller the angle, the smaller the dead space therein.

The toner tank 32 includes a fluid bed formed of porous air discharge members 33, 34, 35 and 36 at the bottom.

The toner tank 32 preferably has a rectangular axial section because of having the maximum capacity.

A local fluidizer 38 locally fluidizing the toner is located at the lowermost part thereof, i.e., a joint of the gradients forming a "V".

The porous air discharge members 33, 34, 35 and 36 have pores passing air, and preferably have aperture ratios of from 5 to 40%, and more preferably from 10 to 20%. Further, the porous air discharge members 33, 34, 35 and 36 preferably have an average aperture of from 3 to 20 μm, and more preferably from 5 to 15 μm because a toner typically has a volume-average particle diameter of from 3 to 15 μm. In addition, the porous air discharge members 33, 34, 35 and 36 preferably have an average pore diameter of from 0.1 to 5.0 times, and more preferably from 0.5 to 3.0 times of the volume-average particle diameter of the toner. Even when the toner comes in or blocks the pore, the toner can be discharged by air.

Materials for the porous air discharge members 33, 34, 35 and 36 are not particularly limited, and include glasses, sintered particulate resins, photo-etched resins, thermally-bored porous resins, sintered metals, bored metal plates, net laminated materials, metals having a selective melted pore print, and the like, which are prepared by the following method:

electrochemically separating out copper around a easily-meltable metallic thread; and heating the copper penetrated and implanted with the easily-meltable metallic thread to selectively remove the easily-meltable metallic thread.

Air chambers 33*a*, 34*a*, 35*a* and 36*a* are located under the porous air discharge members 33, 34, 35 and 36. The porous air discharge members 33 and 34 located below the porous air discharge members 35 and 36 have areas smaller than those of the porous air discharge members 35 and 36. Similarly, the air chambers 33*a* and 34*a* located below the air chambers 35*a* and 36*a* have capacities smaller than those of the air chambers 35*a* and 36*a*.

A nearly L-shaped air tube 38*a* and a connector 38*b* located above the air tube 38*a*, which is openly connecting an aspiration mouth of a toner aspiration tube 37 aspirating the toner, are fixed on the local fluidizer 38.

An end of the air tube 38*a* partially penetrates the porous air discharge member 34 and is fixed with a fixer (not shown) in the air chamber 34*a*. When the air pump 24 supplies air into the air chamber 34*a*, the air passes through the air tube 38*a* and discharges the air into the toner tank 32. A solenoid valve (not shown) is located at the other end of the air tube 38*a*, and is opened and closed to supply or not to supply air. The connector 38*b* may be a ring or a rectangular frame.

When the air pump 24 is operated, air is discharged from the porous air discharge members 33, 34, 35 and 36 through the air chambers 33*a*, 34*a*, 35*a* and 36*a* to fluidize the toner in the toner tank 32. The powder toner is fluidized as if a liquid. The fluidized toner is aspirated by the toner pump 22 through the toner aspiration tube 37 and transported to the toner hopper 9 in the duplicator 1. Almost all the toner in the toner tank 32 can be transported because the toner is aspirated around the lowermost position thereof.

In the present invention, the toner is transported to the duplicator 1 located at a position higher than the toner tank 32. Therefore, even when a transport tube between the toner supplier 20 and the duplicator 1 is broken or mistakenly disengaged, the toner in the toner tank 32 does not scatter and only the toner passing in the transport tube scatters.

Since the air chambers 33*a* and 34*a* located below the air chambers 35*a* and 36*a* have capacities smaller than those of the air chambers 35*a* and 36*a*, and the porous air discharge members 33 and 34 located below the porous air discharge members 35 and 36 have areas smaller than those of the porous air discharge members 35 and 36, air discharged from the porous air discharge members 33 and 34 is more uniform than that discharged from the porous air discharge members 35 and 36.

Further, since the aspiration mouth of the toner aspiration tube 37 is openly connected above the air tube 38*a*, air is discharged without fail around the aspiration mouth of the toner aspiration tube 37 and toner is more smoothly fluidized. Therefore, the toner is not stuck in the toner aspiration tube 37.

Near the aspiration mouth of the toner aspiration tube 37, a near-end sensor 39 detecting a toner is located. The near-end sensor 39 includes sensors 39*a*, 39*b* and 39*c*, wherein the sensor 39*b* is located below the sensor 39*a* and the sensor 39*c* is located below the sensor 39*b*.

Above the toner tank 32, a filter 45 preventing the inner pressure of the toner tank 32 from increasing due to the air supplied therein is located. The filter 45 may be located on the lateral side of the toner tank 32 if located above the toner load line. The filter 45 may be formed of the same materials as those of the porous air discharge members 33, 34, 35 and 36, a Gore-Tex sheet which is a continuous porous structure of a fluorine-containing resin, and the like.

In the toner supplier 20, the toner tank unit 31 can be taken out from the fixed part 21, and therefore, when the toner tank 32 is almost empty, only the toner tank unit 31 is exchanged with another toner tank unit 31 to continuously supply the toner. The toner tank unit 31 has an electric source separate from that of the image forming apparatus 10 having the duplicator 1. Therefore, when a toner remains in the image forming apparatus 10, the toner tank unit 31 can be exchanged without turning off the power of the image forming apparatus 10.

In the present invention, the toner tank unit 31 includes the waste toner collection container 40, and a waste toner collected from the photoreceptor drum 4 and transfer belt 6 of the duplicator 1 of the image forming apparatus 10 when cleaned is transported to the waste toner collection container 40.

Specifically, a waste toner removed by the cleaner 8 is transported to the waste toner collector 12 through a transport route 13 and accumulated therein. A waste toner removed by the belt cleaner 8*a* is transported to the waste toner collector 12 through a transport route 14. The waste toner collector 12 includes a fluid bed formed of a porous material 15 as the toner tank 32 does, and the air pump 25 discharges air therefrom. The waste toner is fluidized by the discharged air, aspirated by the waste toner pump 23 and is transported into the waste toner collection container 40 in the toner tank unit 31.

The waste toner collection container 40 in the toner tank unit 31 need not be so large as the toner tank 32 if it can contain a specific amount of the toner, which is determined from an amount thereof in the tank. In addition, the waste toner collection container 40 does not externally receive a stress because of being located in the toner tank unit 31. Therefore, the waste toner collection container 40 can be formed of a flexible resin bag such as a vinyl bag and a polyethylene bag. The waste toner collection container 40 is set on a setter 41 with a rubber band, and the like.

The setter 41 includes a pipe 42 the waste toner is transported through and a filter 43 removing air from the waste toner collection container 40. Pre-installed on the setter 41, the pipe 42 and filter 43 are easily connected to the waste toner collection container 40 when set on the setter 41.

Next, an operation of controlling the toner supplier 20 will be explained, referring to FIG. 6.

FIG. 6 is a schematic diagram of an embodiment of the toner supplier 20 of the present invention. The fixed part 21 of the toner supplier 20 includes a control board 50 and a modem 60. The control board 50 controls the operation and functions of the toner supplier 20. The modem 60 is a communicator for the toner supplier 20 when connected to an external apparatus through networks. The external apparatus includes a controller controlling the toner supplier 20.

The control board 50 includes a controller 51 and a usage information detector 52. The controller 51 controls an electric source 53, a display 21*a*, the air pumps 24 and 25, the toner pump 22, the waste toner pump 23, and a solenoid valve 54; and sends and receives data to and from the image forming apparatus 10.

The usage information detector 52 detects the toner usage information from various sensors mentioned below. The usage information detector 52 detects a remaining amount of the toner with the near-end sensor 39 in the toner tank 32. The usage information detector 52 detects the temperature and humidity of air supplied to the toner tank 32 with a temperature sensor 55 and a humidity sensor 56 located on the fixed part 21 to detect the temperature and humidity in the toner tank 32. Further, the fixed part 21 includes a temperature sensor 58 detecting the external temperature. The usage information detector 52 detects disturbances of the toner supplier 20 from a difference between the external temperature and the temperature in the toner tank 32, which is detected by the temperature sensor 55.

The usage information detector 52 detects a pressure of air supplied from the air pump 24 into the toner tank 32 with a pressure sensor 57 located on the fixed part 21. In addition, the usage information detector 52 detects revolutions of a toner motor 22*a* activating the toner pump 22 and a waste toner motor 23*a* activating the waste toner pump 23.

The modem 60 is a communicator for the toner supplier 20 when connected to an external apparatus through networks, and may be connected to a LAN (Local Area Network) or a public line.

The toner supply system using the toner supplier 20 of the present invention will be explained, referring to FIG. 7.

Figure 7:
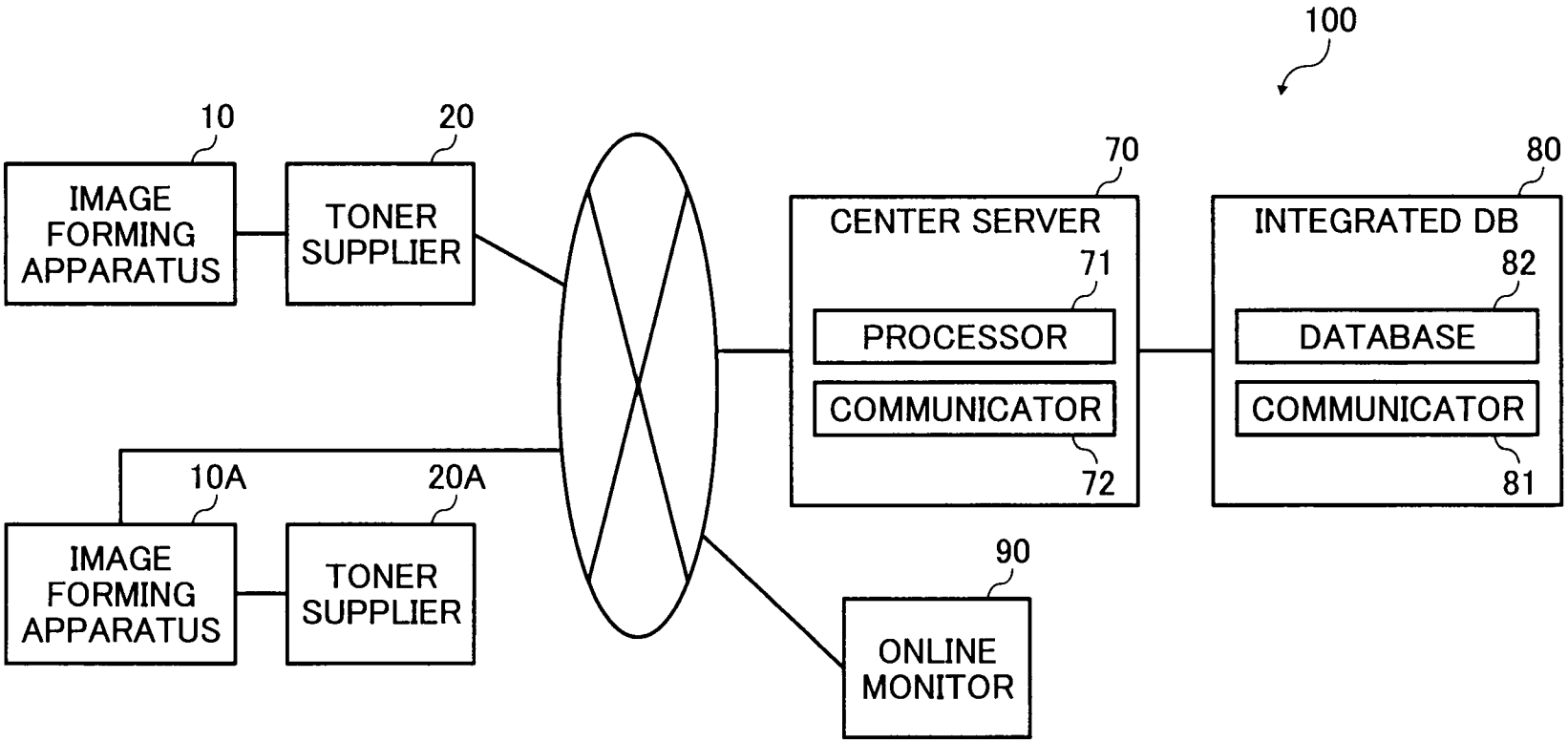
FIG. 7 is a configuration diagram of a toner supply system of the present invention.

FIG. 7 is a configuration diagram of a toner supply system 100 of the present invention.

The toner supply system 100 is connected through networks with the toner supplier 20 connected to the image forming apparatus 10, a center server 70, an integrated DB (DB) 80 and an online monitor 90. An image forming apparatus 10A and a toner supplier 20A in FIG. 7 will be explained in Example 2 of the present invention.

In the toner supply system 100, the toner supplier 20 transmits the status information thereof and the toner usage information to the center server 70. The center server 70 computes a remaining amount and a supply timing of the toner, and controls the operation of the toner supplier 20. The center server 70 transmits the information from the toner supplier 20 to the integrated DB 80, and the information can be accumulated therein. The online monitor 90 is monitoring the information detected by the toner supplier 20 in real time so that the producer can constantly browse the information.

The image forming apparatus 10 forms an image with a toner supplied from the toner supplier 20. The image forming apparatus 10 includes a communicator 130 communicating with the toner supplier 20, and when a toner is short in the image forming apparatus 10, the shortage information may be transmitted from the communicator 130 to the toner supplier 20.

The toner supplier 20 accumulates the usage information detected by the usage information detector 52 in a memory (not shown) in the toner supplier 20. The toner supplier 20 transmits the usage information accumulated in the memory to the center server 70 through the modem 60 with an individual identification of the toner supplier 20. The individual identification is, e.g., a serial number of the toner supplier 20. The process in the toner supplier 20 will be explained later in detail.

The center server 70 is, e.g., a computer including a display and a processor 71 such as a CPU, and includes a communicator 72 communicating with the toner supplier 20 and the integrated DB 80.

A processor 71 computes a remaining amount, a supply timing and a supply amount of the toner based on the toner usage information transmitted by the toner supplier 20 and received by the communicator 72. The center server 70 transmits the usage information from the toner supplier 20, the results computed by the processor 71 and the individual identification of the toner supplier 20 to the integrated DB 80. The process in the center server 70 will be explained later in detail.

The integrated DB 80 is, e.g., a computer including a communicator 81 communicating with the center server 70 and a database 82 accumulating information received by the communicator 81. The usage information and the computed results transmitted by the center server 70 are accumulated in the database 82, strapped with the individual identification of the toner supplier 20.

The online monitor 90 is, e.g., a computer including a display and a communicator (not shown) and is monitoring the toner usage information received from the toner supplier 20 in real time so that the producer can constantly browse the information.

Next, the procedure in the toner supplier 20 will be explained.

In the toner supplier 20 connected to the image forming apparatus 10, when an electric source 53 is on, the controller 51 illuminates a LED 21*b* displaying the status of the electric source 53 in LEDs forming the display 21*a*. The usage information detector 52 starts detecting the usage information on the toner supplier 20 from each of the sensors and motors mentioned above.

Hereinafter, the usage information detection of the toner supplier 20 will be explained, referring to FIG. 8.

Figure 8:
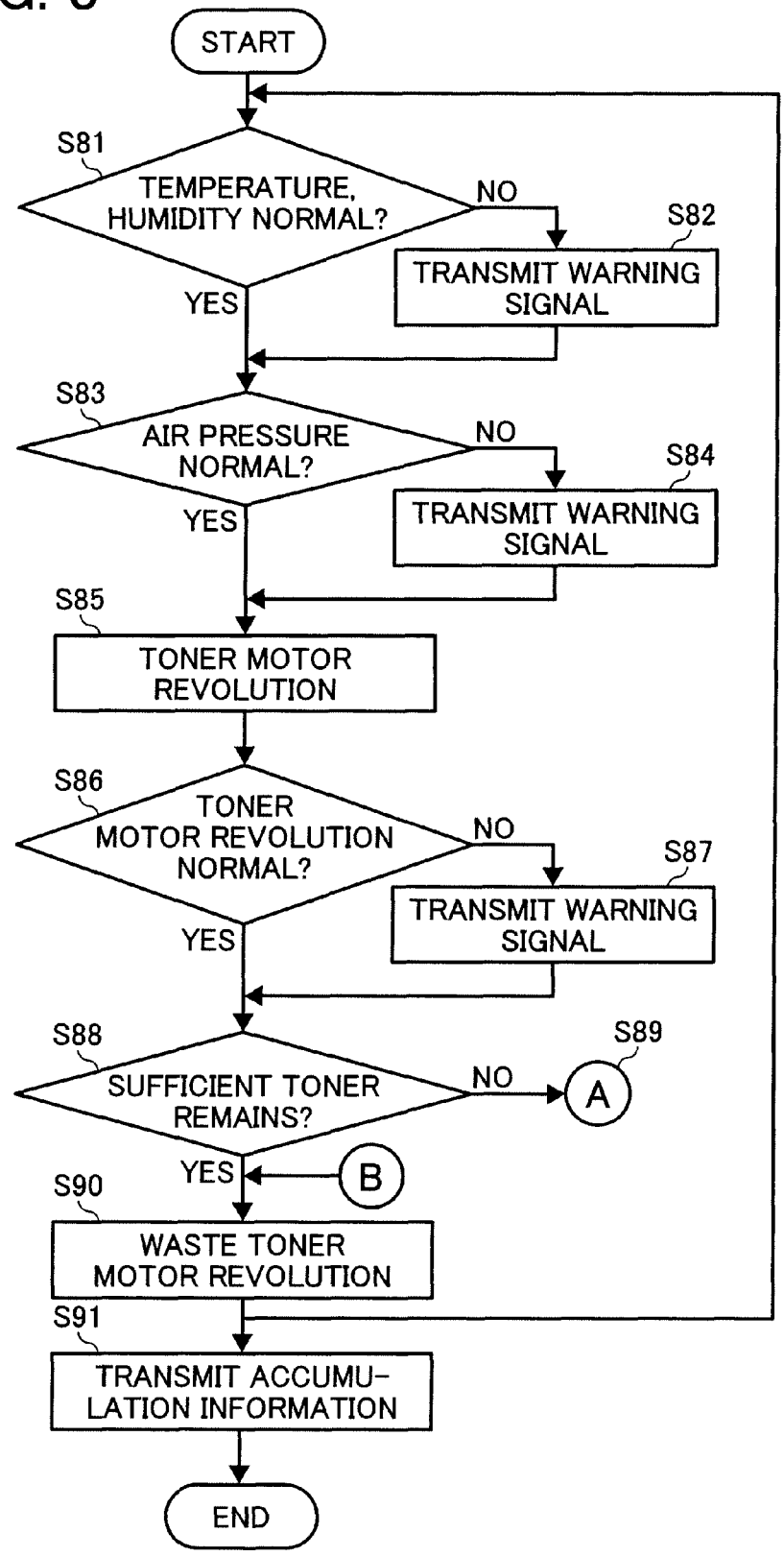
FIG. 8 is a flow chart for explaining an information detection process of the toner supplier of the present invention.

FIG. 8 is a flow chart for explaining an information detection process of the toner supplier 20.

The usage information detector 52 detects the temperatures and humidities in the toner tank 31 and of the toner supplier 20 through the temperature sensor 55, humidity sensor 56 and temperature sensor 58 and decides whether the temperatures and humidities are normal (S81). At S81, when the usage information detector 52 detects a disturbance of the temperatures and humidities, the controller 51 transmits a warning signal notifying the disturbance of the temperatures and humidities to the center server 70 through the modem 60 with the individual identification of the toner supplier 20 (S82) . The controller 51 illuminates a LED 21*c* displaying a disturbance of the apparatus in LEDs forming the display 21*a*. The normal temperatures are preferably from −20° C. to +60° C.

At S81, when the temperatures and humidities are normal, the usage information detector 52 detects whether the air pressures of the air pumps 24 and 25 are normal with a pressure sensor 26 (S83) . At S83, when the usage information detector 52 detects a disturbance of the air pressures, the controller 51 transmits a warning signal notifying the disturbance of the air pressures to the center server 70 through the modem 60 with the individual identification of the toner supplier 20 (S84). The controller 51 illuminates a LED 21*c* displaying a disturbance of the apparatus in LEDs forming the display 21*a*. The normal air pressures are preferably from 0.05 to 0.60 Kpa.

At S83, when the air pressures are normal, the usage information detector 52 detects the revolution of the toner motor 22*a* activating the toner pump 22 (S85) . Next, the usage information detector 52 detects the revolution speed of the toner motor 22*a* and decides whether the revolution of the toner motor 22*a* is normal (S86).

At S86, when the usage information detector 52 detects a disturbance of the revolution speed of the toner motor 22*a*, the controller 51 transmits a warning signal notifying the disturbance of the revolution speed of the toner motor 22*a* to the center server 70 through the modem 60 with the individual identification of the toner supplier 20 (S87) . The controller 51 illuminates a LED 21*c* displaying a disturbance of the apparatus in LEDs forming the display 21*a*. The normal revolution speed is preferably from 300 to 1,000 rpm.

Next, the usage information detector 52 detects with the near-end sensor 39 whether the remaining amount of the toner in the toner tank 32 is sufficient (S88). At S88, when a near-end, i.e., that the remaining amount of the toner in the toner tank 32 is insufficient, is detected, the usage information detector 52 goes to a process A at S89. The process after the near-end is detected will be separately explained, referring to FIG. 9.

At S88, detecting the remaining amount of the toner in the toner tank 32 is sufficient, the usage information detector 52 detects the revolution of the waste toner motor 23*a* activating the waste toner pump 23 (S90).

In the processes of from S81 to S90, the information detected by the usage information detector 52 is accumulated in the memory (not shown) in the toner supplier 20. The controller 51 transmits the accumulated information to the center server 70 at a predetermined time (S91).

Next, a process when the usage information detector 52 detects the near-end will be explained, referring to FIG. 9.

Figure 9:
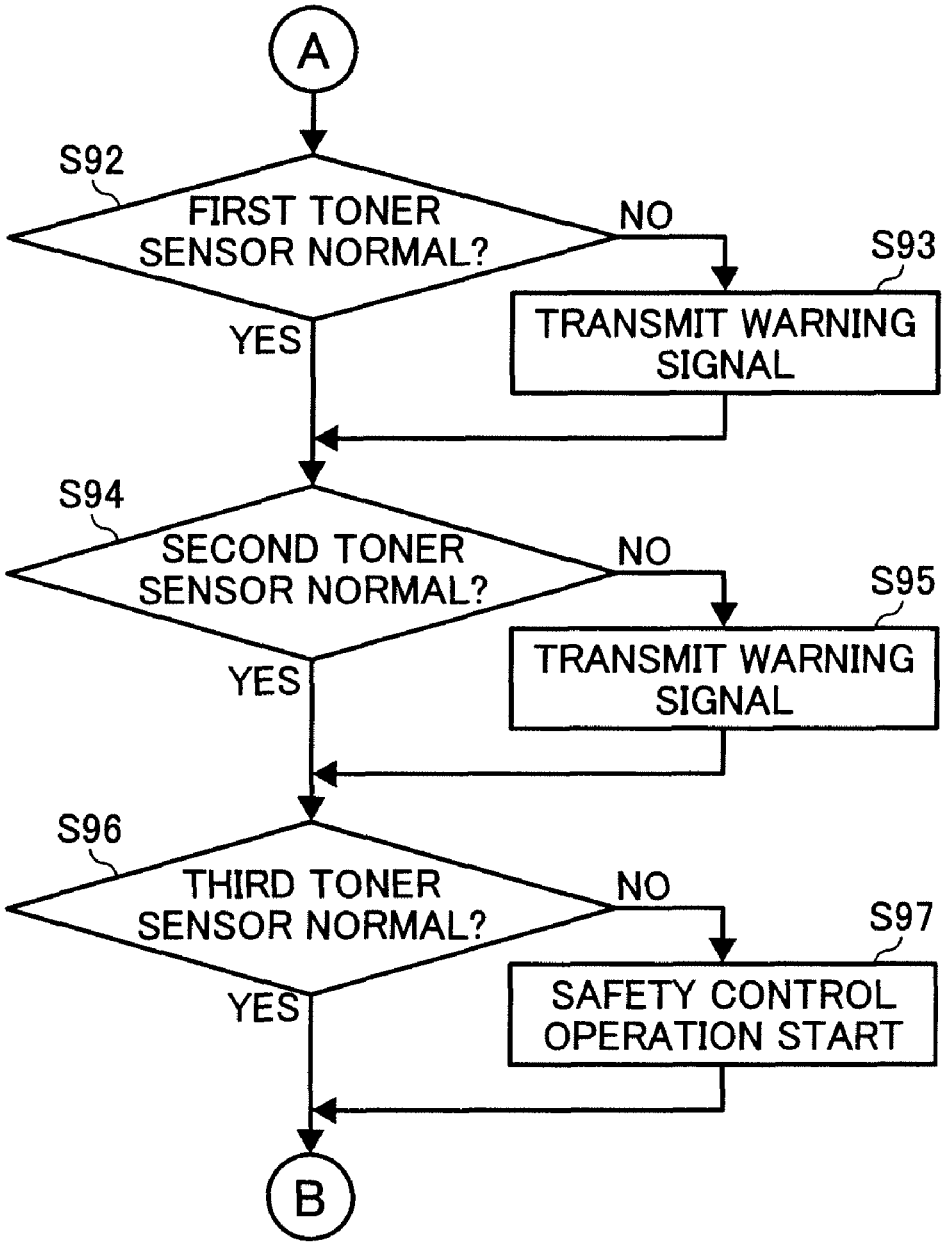
FIG. 9 is a flow chart for explaining a near-end detection process in the toner supplier of the present invention.

FIG. 9 is a flow chart for explaining a near-end detection process in the toner supplier 20.

First, the usage information detector 52 detects with the toner sensor 39*a* whether the toner load line in the toner tank 32 is above a position where the toner sensor 39*a* is located (S92). At S92, when the toner load line is below the toner sensor 39*a*, the controller 51 decides this is a first near-end and transmits a warning signal notifying the first near-end to the center server 70 through the modem 60 with the individual identification of the toner supplier 20 (S93).

Next, the usage information detector 52 detects with the toner sensor 39*b* whether the toner load line is above a position where the toner sensor 39*b* is located (S94) . At S94, when the toner load line is below the toner sensor 39*b*, the controller 51 decides this is a second near-end and transmits a warning signal notifying the second near-end to the center server 70 through the modem 60 with the individual identification of the toner supplier 20 (S95).

Further, the usage information detector 52 detects with the toner sensor 39*c* whether the toner load line is above a position where the toner sensor 39*c* is located (S96). At S96, when the toner load line is below the toner sensor 39*c*, the controller 51 decides this is a third near-end and transmits a warning signal notifying the third near-end to the center server 70 through the modem 60 with the individual identification of the toner supplier 20 and starts a safety control operation stopping the toner supply operation (S97). The safety control operation includes, e.g., stopping the toner pump 22 and toner motor 22*a* supplying the toner into the toner tank 31, and stopping the air pump 24 supplying air thereinto to fluidize the toner.

At S96, when the third near-end is not detected, the usage information detector 52 returns to B in FIG. 8 and continues processes from S90. The controller 51 illuminates a LED 21*d* displaying the near-end status in LEDs forming the display 21*a*. The LED 21*d* may be illuminated when the first and/or the second near-end are/is detected. The LED 21*d*is preferably illuminated before the third near-end is detected, but may be illuminated when the third near-end is detected.

Thus, the usage information detector 52 detects the near-end of the toner contained in the toner tank 32.

Next, the processes in the center server 70 will be explained. The center server 70 has a display (not shown) which can display the computed results of the processor 71 and the information received by the communicator 72 such that the producer can browse.

When the center server 70 receives the individual identification and the warning signal notifying the disturbance of the temperature transmitted at S82 in FIG. 8, it displays that the toner supplier 20 having the identification has a disturbance of the temperature in the display. The center server 70 thereby prompts the producer to exchange the toner tank 32 in the toner supplier 20.

When the center server 70 receives the individual identification and the warning signal notifying the disturbance of the air pressure transmitted at S84 in FIG. 8, it displays that the toner supplier 20 having the individual identification has a disturbance of the air pressure in the display. The center server 70 thereby prompts the producer and the manager doing maintenance on the toner supplier 20 to do maintenance thereon.

The center server 70 computes an amount of the toner supplied to the image forming apparatus 10 from the toner tank 32, based on the revolution of the toner motor 22*a*, detected at S85 in FIG. 8. The amount of the toner supplied thereto is determined by, e.g., the following formula:

Revolution of the toner motor 22*a* times a coefficient, wherein the coefficient relates to the toner fluidity such as fluidizing conditions and toner properties, and to a specification of the toner motor 22*a*, e.g., 0.045 g.

The center server 70 displays the computed amount of the toner supplied to the image forming apparatus 10 in the display with the relevant identification of the toner supplier 20. The center server 70 thereby lets the producer know the toner usage status in the toner supplier 20. In addition, the center server 70 computes a maintenance time of the toner motor 22*a* based on the revolution of the toner motor 22*a*. The maintenance time of the toner motor 22*a* is determined by the following formula:

7,000,000 sec minus stored motor revolutions/sec.

The center server 70 displays the maintenance time in the display and to let the manager doing maintenance on the toner supplier 20 know the maintenance time.

When the center server 70 receives the individual identification and the warning signal notifying the disturbance of the revolution speed of the toner motor 22*a* at S87 in FIG. 8, it displays that the toner supplier 20 having the individual identification has an operation disturbance of the toner motor 22*a* in the display. The center server 70 thereby prompts the producer and the manager doing maintenance on the toner supplier 20 to do maintenance thereon.

When the center server 70 receives the individual identification and the warning signal notifying the first, second and third near-end detection at S93 and S95 in FIG. 9, it displays that the toner supplier 20 having the individual identification is short of a remaining amount of the toner and the status thereof of the first, second or third near-end detection in the display. The center server 70 thereby prompts the producer to prepare exchanging the toner tank 32.

Further, when the center server 70 receives a warning signal notifying the near-end detection, the processor 71 computes the remaining amount of the toner. The center server 70 displays the computed remaining amount of the toner and the exchange time of the toner tank 32, assumed therefrom, in the display with the relevant individual identification of the toner supplier 20. The center server 70 thereby lets the producer and the manager doing maintenance on the toner supplier 20 know the exchange time of the toner tank 32.

The remaining amount of the toner is determined by the following formula:

Initial amount of the toner in the toner tank 32 minus supply amount of the toner.

When the remaining amount of the toner is too large, the center server 70 displays that the apparatus has a disturbance in the display.

The center server 70 computes a collection amount of the waste toner, based on the revolution of the waste toner motor 23*a*, detected at S90 in FIG. 8. The collection amount of the waste toner is determined by, e.g., the following formula:

Revolution of the waste toner motor 23*a*times a coefficient, wherein the coefficient relates to the toner fluidity such as fluidizing conditions and toner properties, and to a specification of the waste toner motor 23*a*, e.g., 0.022 g. The maintenance time of the waste toner motor 23*a* is also displayed in the display as the toner motor 22*a* is, and is known to the manager doing maintenance on the toner supplier 20.

Since the information in the center server 70 is transmitted to the integrated DB 80 and stored therein, and strapped with the individual identification of the toner supplier 20, the producer and the manager doing maintenance can refer to even the past information, reading out that from the integrated DB 80.

As having been explained, in the toner supply system 100 of the present invention, the toner producer and the manager doing maintenance on the toner supplier can constantly know the toner usage information and the status of apparatus such as a disturbance of the toner supplier 20.

Therefore, the toner tank 32 can timely be exchanged in the toner supplier 20.

The toner tank 32 has a large capacity to contain a toner and the number of exchange times thereof can largely be reduced. Further, the toner tank 32 can easily be moved and exchanged.

Therefore, the toner supply system 100 of the present invention saves time for users to fill the toner. Further, the statuses of the toner supplier and toner usage are constantly monitored by the producer and manager, and therefore the users do not have to consider them.

Another embodiment of the present invention will be explained.

Figure 10:
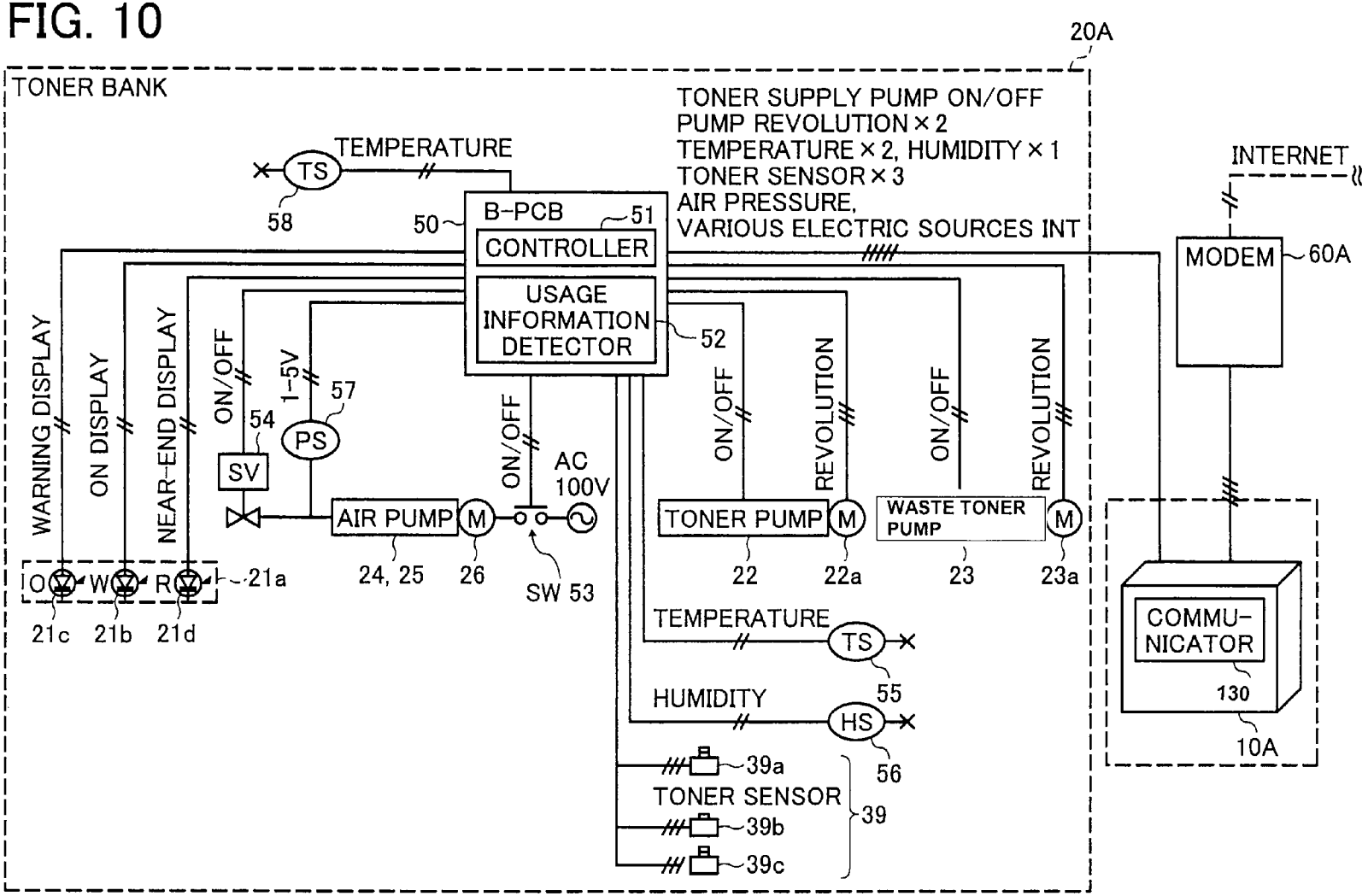
FIG. 10 is a schematic diagram of another embodiment of the toner supplier of the present invention.

FIG. 10 is a schematic diagram of another embodiment of a toner supplier 20A of the present invention.

An image forming apparatus 10A and the toner supplier 20A have almost same structures as those of the image forming apparatus 10 and the toner supplier 20, but a modem 60A is located outside of the toner supplier 20A, which is different from the modem 60 fixed on the fixed part 21 of the toner supplier 20.

Therefore, the location of the modem 60A will be explained, referring to FIG. 10. In a toner supplier 20A, those having the same structures and functions as those in the toner supplier 20 have the same codes as those in FIG. 6, and explanations thereof are omitted.

The toner supplier 20A does not include a communicator communicating with an outer apparatus such as a center server through networks, which is different from the toner supplier 20.

A controller 51 constantly transmits information detected by a usage information detector 52 to the image forming apparatus 10A. The image forming apparatus 10A includes a memory (not shown). The modem 60A communicating with outer apparatus such as a center server 70 connected to the image forming apparatus 10A through networks is properly connected thereto (FIG. 7).

In the image forming apparatus 10A, a communicator 130 receives the information on the toner supplier 20A and the toner usage transmitted from the toner supplier 20A, and the information is stored in the memory. The image forming apparatus 10A transmits the information stored in the memory to the center server 70 through the modem 60A.

The modem 60A may be installed in the image forming apparatus 10A. Further, the communicator 130 may have the same function as that of the modem 60A.

The embodiments having been described are provided herein for the purpose of illustration only and are not intended to be limiting.

Having now fully described the invention, it will be apparent to one of ordinary skill in the art that many changes and modifications can be made thereto without departing from the spirit and scope of the invention as set forth therein.

What is claimed is:

1. A toner supplier, comprising:

a toner container configured to contain a toner;

an air discharger configured to discharge air from a bottom of the toner container to form a fluidized toner;

a detector configured to detect usage information of the toner contained in the toner container; and a communicator configured to send and receive the usage information, wherein the communicator is configured to communicate with an image forming apparatus connected to the toner supplier and a controller connected to the toner supplier.

2. The toner supplier of claim 1, further comprising:

an aspirator configured to aspirate the fluidized toner, wherein the air discharger comprises an air pump.

3. The toner supplier of claim 1, wherein the air discharger comprises a porous member.

4. The toner supplier of claim 1, wherein the toner container has an inclined bottom comprising the air discharger.

5. The toner supplier of claim 1, further comprising at least one detector configured to detect a remaining amount of the toner in the toner container.

6. The toner supplier of claim 5, wherein the at least one detector further comprises a plurality of detectors.

7. The toner supplier of claim 1, further comprising:

a local fluidizer configured to engage an aspirating mouth of an aspirator with the air discharger.

8. The toner supplier of claim 1, wherein the usage information comprises at least one of information of a temperature and humidity in the toner container, information of a revolution of an air pump, and information detected by the detector of a remaining amount of the toner.

9. An image forming apparatus, comprising:

an image former configured to form a toner image with a toner;

a fixer configured to fix the toner image on a recording medium;

a toner supplier configured to supply a toner to the image forming apparatus; and a first communicator configured to communicate with a first controller controlling the toner supplier, wherein the toner supplier comprises:

a toner container configured to contain a toner;

an air discharger configured to discharge air from a bottom of the toner container to form a fluidized toner;

a detector configured to detect usage information of the toner contained in the toner container; and a second communicator configured to communicate with the image forming apparatus and a second controller connected to the toner supplier, wherein the second communicator receives the usage information from the first communicator and transmits the usage information to the second controller.

10. A method of supplying a toner, comprising:

discharging air from a bottom of a container containing the toner to fluidize the toner;

aspirating the fluidized toner from the container;

detecting usage information of the toner in the container; and transmitting the usage information to a controller.

11. A toner supply system, comprising:

a toner supplier having an individual identification;

a processor configured to generate processed toner information; and a controller having a first communicator configured to communicate with the toner supplier, wherein the toner supplier comprises:

a toner container configured to contain a toner;

an air discharger configured to discharge air from a bottom of the toner container to form a fluidized toner;

a detector configured to detect usage information of the toner contained in the toner container; and a second communicator configured to communicate with the controller, wherein the first communicator receives the usage information and the individual identification from the second communicator, and the processed toner information includes at least one of a remaining amount of the toner in the toner container, a time for filling the toner therein, and a supply amount of the toner relevant to the individual identification, based on the usage information.

12. The toner supply system of claim 11, further comprising:

a database having a third communicator configured to communicate with the controller, wherein the first communicator is configured to transmit the individual identification and the processed toner information to the third communicator, and the database is configured to store the processed toner information received by the third communicator.

13. A toner supply system, comprising:

an image forming apparatus;

a toner supplier connected to the image forming apparatus and having an individual identification;

a processor configured to generate processed toner information; and a controller having a first communicator configured to communicate with the toner supplier, wherein the image forming apparatus comprises a second communicator configured to communicate with the toner supplier, and wherein the toner supplier comprises:

a toner container configured to contain a toner;

an air discharger configured to discharge air from a bottom of the toner container to form a fluidized toner;

a detector configured to detect usage information of the toner contained in the toner container; and a third communicator configured to communicate with the image forming apparatus and the controller, wherein the third communicator is configured to receive the usage information and the individual identification from the second communicator, the first communicator is configured to receive the usage information and the individual identification from the third communicator, and the processed toner information includes at least one of a remaining amount of the toner in the toner container, a time for filling the toner therein, and a supply amount of the toner relevant to the individual identification, based on the usage information.

14. The toner supply system of claim 13, further comprising:

a database having a fourth communicator configured to communicate with the controller, wherein the first communicator is configured to transmit the individual identification and the processed toner information to the fourth communicator, and the database is configured to store the information received by the fourth communicator.

* * * * *